US005312314A

United States Patent [19]

Stephan et al.

[11] Patent Number: 5,312,314

[45] Date of Patent: May 17, 1994

[54] EXERCISE YOKE

[76] Inventors: Paul B. Stephan, 15222 Warwick Cir., Westminster, Calif. 92683; Joe E. Pryor, 715 Paulsen Cir., Compton, Calif. 90220; Montel Williams, c/o Trump Park 100 Central Park S. Apt. 15I, New York, N.Y. 10019

[21] Appl. No.: 1,310

[22] Filed: Jan. 6, 1993

[51] Int. Cl.[5] ..... A63B 23/02; A63B 21/06

[52] U.S. Cl. ..... 482/110; 482/93; 482/106; 482/148

[58] Field of Search ..... 482/93, 104, 105, 106, 482/108, 109, 110, 148, 139

[56] References Cited

U.S. PATENT DOCUMENTS

| | | | |
|---|---|---|---|
| 3,118,668 | 1/1964 | Callahan | 482/104 |
| 3,820,781 | 6/1974 | Kane | 482/110 X |
| 3,843,117 | 10/1974 | Johnson | 482/110 |
| 3,989,241 | 11/1976 | Ourgant . | |
| 4,072,309 | 2/1978 | Wilson . | |
| 4,200,280 | 4/1980 | Goodwin . | |
| 4,218,057 | 8/1980 | Wilson | 482/109 X |
| 4,358,108 | 11/1982 | Voris . | |
| 4,440,391 | 4/1984 | Saenz, Jr. et al. | 482/106 X |
| 4,480,828 | 11/1984 | Kifferstein | 482/93 X |
| 4,505,474 | 3/1985 | Mattox | 482/110 X |
| 4,518,162 | 5/1985 | Oates | 482/93 |
| 4,744,559 | 5/1988 | Mahnke et al. . | |
| 4,770,414 | 9/1988 | Fredrickson et al. | 482/148 |
| 4,863,158 | 9/1989 | Tassope | 482/106 X |
| 4,949,955 | 8/1990 | Keen | 482/93 |
| 4,955,604 | 9/1990 | Pogue | 482/106 X |
| 4,997,184 | 3/1991 | Sherman | 482/108 |
| 5,050,870 | 9/1991 | Pollock | 482/105 |

OTHER PUBLICATIONS

Advertisement from Criterion Body Building Equipment, Feb. 1992, Club Industry Magazine.

Product Review from Fitness Tech, Jun. 1992, Club Industry Magazine.

*Primary Examiner*—Robert Bahr

*Attorney, Agent, or Firm*—Trask, Britt & Rossa

[57] ABSTRACT

A bar preferably formed of tubular aluminum is formed to have a yoke and extensions for holding the shoulders of a user in a neutral position for exercising. Trunk twists and bends may be performed using the bar to maintain positions of the arms and torso for maximum effectiveness of the exercises. The bar is configured for adding weight inside or outside and particularly at its ends for increasing the rotational moment of inertia of the bar to give the effect of greater weight. End caps are configured to conveniently secure weights within or around the bar, by friction and threaded engagement. Weight materials include water, shot, cylinders, wheels and annuli configured as dead weights. The weight greatly enhances the moment of inertia when the bar is in motion during exercises, and can also be used with a leverage advantage to increase its effectiveness over conventional dead weights.

42 Claims, 10 Drawing Sheets

EXERCISE YOKE

BACKGROUND OF THE INVENTION

1. Field

This invention relates to exercise equipment and, more specifically, to bars for exercising the upper body, particularly the torso, such as in bending and twisting exercises.

2. State of the Art

Exercise equipment is a crowded art. Exercise machines for simulating numerous competitive and athletic activities are marketed. In addition, numerous patents abound from the 19th and 20th centuries for exercise apparatus. Free weights, such as barbells and dumbbells, are produced by numerous manufacturers. In addition, numerous exercise stations for developing specific muscle groups exist.

Yokes for cattle, and for persons carrying loads have been known for hundreds of years, and probably for millennia. In exercise equipment, yokes and bars are used for various purposes. Barbells use a common bar, typically cylindrical or annular in cross section. Exercise machines use various bars and levers to position resistance properly with respect to the body.

U.S. Pat. Nos. 3,989,241 (Ourgant 1976), 4,072,309 (Wilson 1978), 4,200,280 (Goodwin 1980), 4,358,108 (Voris 1982) and 4,744,559 (Mahnke et al. 1988) disclose bars which can be gripped by the hands of a user and brought near the neck and shoulders. Most are associated with exercise machines. A commercialized bar is advertised as the EXERSTIK TM. It is a bar for use in exercises and has a depression to fit over the neck. Consumer publications and trade magazines like Club Industry advertise various bars and machines periodically for exercising at home or spas.

Small, transportable exercise equipment has its adherents likewise. Exercise equipment having wheels, handles, ropes, bands and other structures fit in suitcases for the traveler.

Athletes have long used either a barbell bar or a wooden shaft, such as a broomstick, for exercising the torso in bending and twisting exercises. In a torso-twisting exercise, also called trunk twists, a user places a bar or rod over the shoulders behind the neck. In a standing position, a user wraps a hand around each opposite end of the bar. Holding on to the bar assures that shoulder, chest and back muscles close to the shoulders stay in the same relative positions. The upper torso becomes a rigid body with respect to the waist. The bar also keeps body weight high and at maximum diameter about an axis of rotation. If a barbell is used, the angular momentum of the bar as it rotates with the body of a user must be overcome to change the direction of rotation. The additional moment of inertia of the heavy, long bar can substantially influence the rate of energy burned by a user as well as the force required to change direction of twist in a specified time.

A bar for torso twists can also be used to maintain posture and balance for other exercises. Sometimes a bar can be used for exercising one member of the body against another in isometric relation.

Bars have drawbacks. A bar behind the neck puts most of the muscle groups in the upper body out of their natural position. Biceps, triceps, latissimus dorsi, trapezius, upper pectorals and shoulders are all moved to a non-neutral position, a stressed non-equilibrium position. Likewise, the neck is moved forward to an unnatural position. Because various muscles are moved from their natural unstressed positions, their tendency to return to a relaxed neutral position puts force on the bar. Force on the bar also tends to create soreness in the upper back where the bar rests across the shoulder, and against the neck where muscles are compressed between the hard bar and the internal vertebrae.

Discomfort of a user is a disincentive to continue to exercise. An uncomfortable user will cease exercising entirely in some cases. In many cases, a user will cut short a daily regimen which causes continued discomfort.

Muscles which are not in their relaxed equilibrium position are said to not be neutralized. Non-neutralized muscle groups are being exercised in an isometric fashion. Muscles can become sore. Also, muscles which are extended more may become sore or are improperly developed in relationship to other muscle groups. Much of exercise technology addresses balanced building of all muscle groups.

For torso twists, a bar is needed which allows all upper body muscle groups to be relaxed in a neutral position. Thus, muscles are only stressed due to the exercise, not due to the mere presence of the bar. The bar needs to be comfortable over the neck and shoulders. The bar should allow various hand positions between shoulder width and full radial extension. The bar should be adaptable for use by users of different sizes and ages.

A bar which is portable has added convenience, a factor of commercial importance. The bar preferably can be varied in weight between the weight of a broomstick and the weight of a barbell bar.

The bar should have the capability to add a large moment of inertia. Large moments of inertia are achieved by additional mass and additional distance between the mass and the center of rotation. The bar should be useful for a variety of exercises in addition to torso twists so that a user can maximize the utility of an investment in the bar as an exercise apparatus. An exercise device which can exercise different muscle groups by slight changes or simply by different exercise methods is more desirable to many users.

SUMMARY OF THE INVENTION

The invention addresses the concerns discussed above. The invention comprises a bar, preferably of tubular aluminum, shaped to be conformal to the neck and shoulder region of a user. The bar is configured to be usable as manufactured or augmented by attaching a weight material. The bar is configured with end caps which seal the inside cavity. A user can fill the cavity with water, steel or lead shot, or may insert various weight means configured for the purpose. Weights may optionally be added externally. The bar is configured to fit comfortably over the neck and shoulders in a yoke fashion without the need for pads to relieve surface pressure on skin, muscles and underlying bone. The bar is configured for manufacture in various diameters and lengths. A portable configuration can dismantle into three or five pieces for packing in luggage. The bar is configured to neutralize (maintain unstressed) the muscles in the neck and shoulder region of the upper body when the bar is grasped by a user.

The bar is used in a variety of exercises. Torso twists can be performed with a standing user grasping the bar in each hand with the yoke portion lying over the neck and the left and right straight ends extending outwardly across the front of the shoulders. Twists around the vertical spine represent one mode of exercise. The hands can be held at shoulder width or extended horizontally outward. Windmill or figure eight exercises with the torso can also be done as well as simple back and forth oscillations about the vertical spine. Exercises in a bent forward position, bending from the waist to point the ends of the bar at the toes, respectively and alternatingly, or simple rotation about the horizontal portion of the spine will give additional extension to certain muscle groups, above and beyond that available in torsional twisting about the vertical spine in a standing position.

DETAILED DESCRIPTION OF THE PREFERRED EMBODIMENTS

Figure 1:
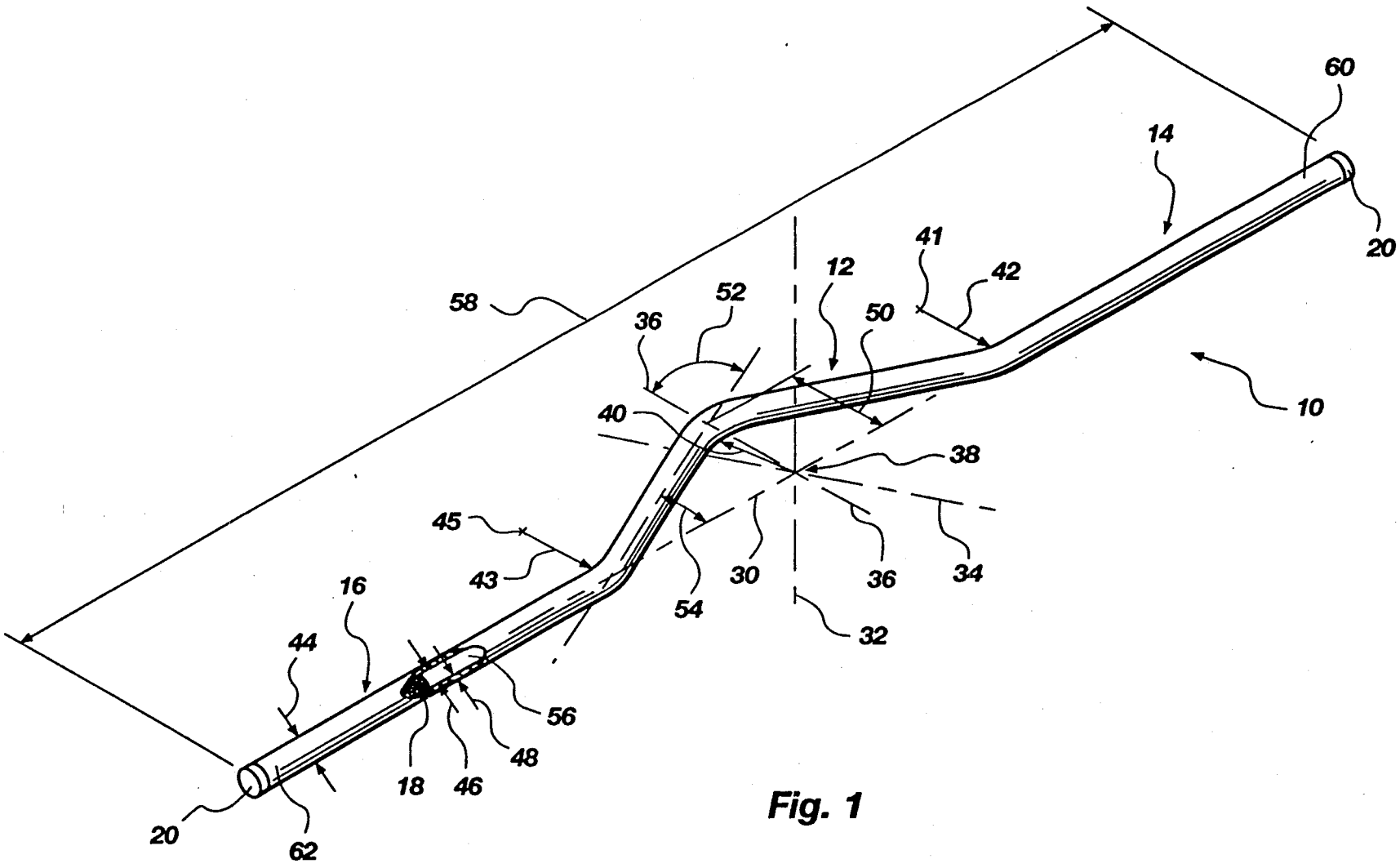
FIG. 1 is a partially cutaway perspective view of the bar of the invention.
Figure 4:
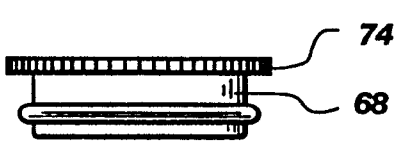
FIG. 4 is a side view of the cap on the container shown in FIGS. 2 and 3.
Figure 3:
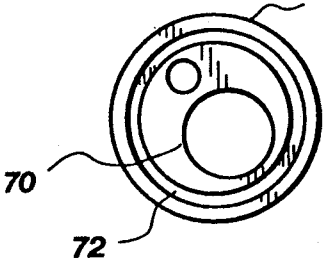
FIG. 3 is a top view of the weight container of FIG. 2.

FIG. 1 shows the bar 10 comprising a yoke portion 12 and a left extension portion 14 and matching right extension portion 16. Weight means 18 is visible in FIG. 1, but various configurations of weight means are shown in FIGS. 2–11. Weight means 18 is secured within bar 10 by caps 20, although other weight may be added external to the bar.

The caps 20 are shown in FIG. 1 and various alternative configurations are shown in FIGS. 12–20. In addition to the bar 10 used alone, a rack system 22, shown in FIGS. 27–29, stores the bar 10 and is employed for other exercises.

Figure 26:
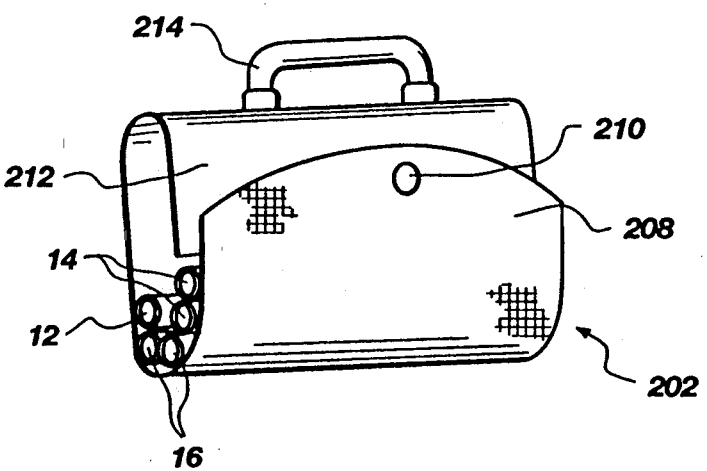
FIG. 26 is a perspective view of the carrying case of FIG. 25 containing the bar of FIG. 24.
Figure 24:
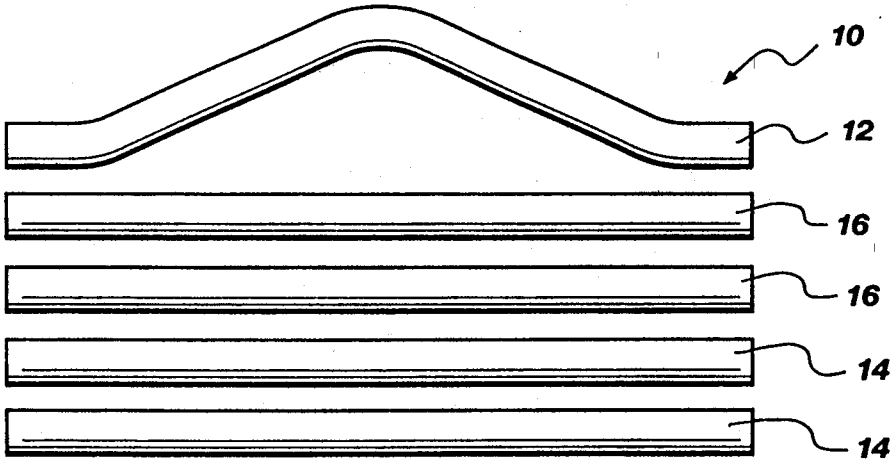
FIG. 24 is a top view of the bar of FIG. 22 configured in 5 segments, and arranged in a takedown mode.
Figure 25:
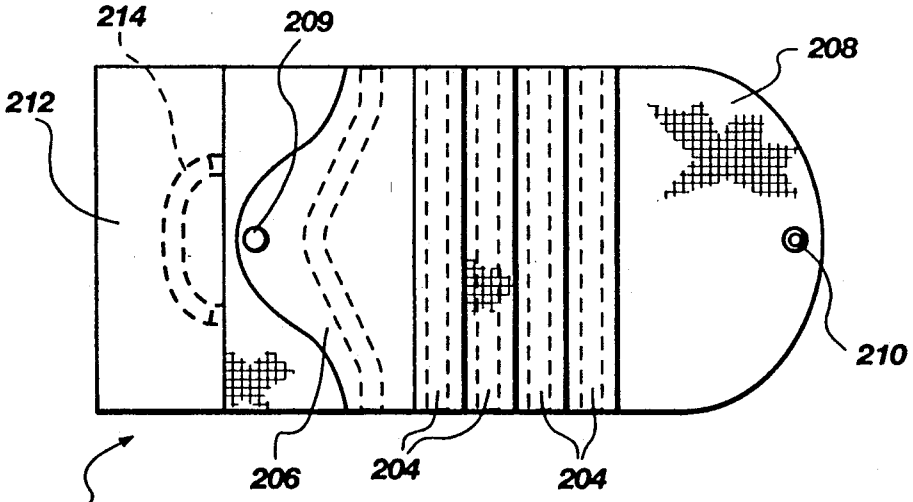
FIG. 25 is a top view of a carrying case for the bar of FIG. 24.

The bar 10 configured in a takedown format of FIGS. 22–26 fits into a carrying case 24 of FIGS. 25 and 26.

Figure 27:
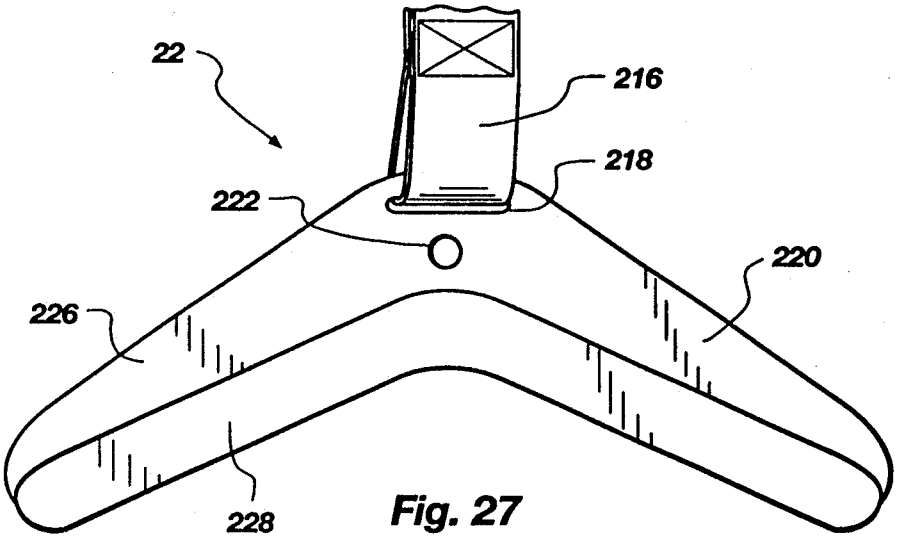
FIG. 27 is a perspective view of a rack for use and storage of the bar of FIG. 1.
Figure 29:
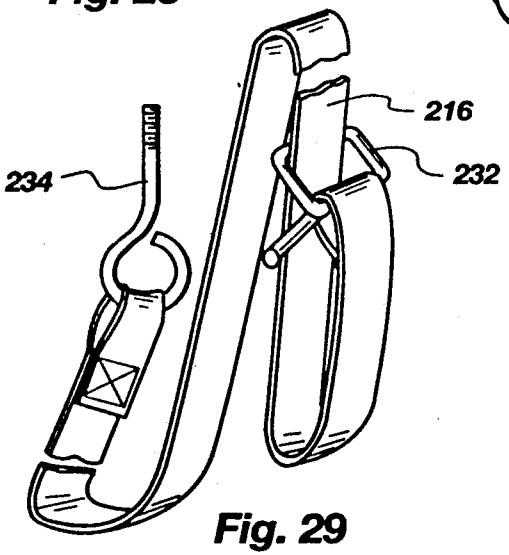
FIG. 29 is a perspective view of a supporting strap system for use with the rack of FIGS. 27 and 28.

The strap 26 of FIGS. 27 and 29 fits into the rack system 22 to support bar 10 for various exercises also.

Returning to FIG. 1, a first axis 30, second axis 32, and third axis 34 correspond approximately to a horizontal axial direction with respect to the bar lying flat on a table, a horizontal transverse direction and a vertical direction, respectively. Nevertheless, first axis 30, second axis 32, and third axis 34 are all with reference to the bar 10. The bar does not maintain a horizontal orientation during exercises.

The bar 10 has a yoke axis 36 intersecting first axis 30, second axis 32, and third axis 34 at an origin 38 and intersecting the center of the yoke portion 12 of bar 10 at all orientations of bar 10 about first axis 30. Thus, yoke axis 36 is always in the plane defined by second axis 32 and third axis 34. Yoke axis 36 defines a plane with first axis 30.

Bar 10 has a first radius 40 in yoke portion 12. In the preferred embodiment, first radius 40 is preferably four inches measured from the origin 38 to the center of the cross section of bar 10. Second radius 42 is measured from the left center of curvature 41, third radius 43 from right center of curvature 45. The second and third radii 42, 43 transition between left and right legs 47, 49 of yoke portion 12 and left and right extension portions 14, 16, respectively. Second and third radii 42, 43 are preferably four inches also. In this preferred embodiment, the bar 10 is configured for an adult male.

Smaller physiques of women and children, may benefit from a different set of measurements for bar 10. The bar outside diameter 44 is preferably 1 ½ to two inches, while bar inside diameter 46 reflects a wall thickness 48 preferably of approximately ⅛ to 1/8 inch for strength and minimum basic weight. Wall thickness 48 can approach ¼ inch in some embodiments but is preferably approximately 80 thousandths of an inch. Bar outside diameter 44 can be useful when as large as three inches, although a two-inch outside diameter 44 is the maximum to which most users would become easily accustomed.

Bar 10 is preferably of drawn aluminum, although extruded aluminum, rolled aluminum and similarly formed steel or stainless can serve with slightly different characteristics.

Yoke depth 50 accommodates the distance between the back of the neck of a user and the front portion of the user's shoulders where left and right extensions 14, 16 lie. Yoke depth 50 is a substantial improvement over other bars which are used. By fitting behind a user's neck, while extending slightly forward of and above the user's shoulders, yoke 12 does not require hands and shoulders to be flexed backwardly. Yoke half angle 52 in the preferred embodiment is an angle of about 65 degrees for a large adult male. Extension angle 54 is preferably approximately 25 degrees in the preferred embodiment.

The combination of design factors including first radius 40, second and third radii 42, 43, left and right legs 47, 49 yoke half angle 52 and extension angle 54 allow construction of a yoke to fit any size person virtually perfectly. One of the preferred embodiments of the invention is a custom-made bar fitted to a user. Since the bar 10 can be worked with tube bending equipment known in the art, a bar 10 can be manufactured from a blank, straight tube of standard length and bent to fit a user's size. The bar 10 is configured to fit comfortably behind the neck of the user while leaving all shoulder, upper back and chest muscles in a neutral position. First radius 40, yoke depth 50, yoke left and right legs 41, 45, extension angle 54 and second and third radii 42, 43 are configured to neutralize those muscles, preventing tension in them, and to prevent soreness and bruising due to pressure of the bar against the skin.

Another important parameter in preventing soreness due to pressure of the bar 10 against the body is bar outside diameter 44. The larger the bar outside diameter 44, the larger area over which force is distributed. Also, the design factors mentioned above allow the bar 10 to be shaped to avoid protrusions of bone near the surface, which protrusions may cause discomfort if pressure is applied directly over them against the skin.

The minimum size of the bar outside diameter 44 is configured large enough to comfortably distribute a load over the surface of the body at the location of contact. The maximum size of the bar outside diameter 44 is limited by the comfort of a users hand gripping the bar 10.

The cross section of the bar 10 is preferably circular, actually annular since it is hollow. An oval (elliptical) cross section is possible, but adds cost. Nevertheless, the minor axis of an elliptical cross section would be limited by the surface pressure on the body and the major axis would be determined by the hand grip as discussed above for diameter. An elliptical cross section can make the grip more comfortable for a large bar than a circular cross section. An ellipse allows the end joints of the fingers to wrap around the minor axis and come close to the palm of a users hand, while the palm spans a larger distance across the major axis of the ellipse.

A rectangular cross section is possible, but would require a radius on each corner comparable to the radius of a circular or elliptical cross section. Weight means 18 would have to be configured to fit the rectangular shape. However, exercises involving rotating the bar 10 about the first axis 30 may be more beneficial with the ability of the bar 10 to rotate weight without slipping about the first axis 30.

In one torso twist exercise mode, a user stands with the yoke 12 behind the neck and the left and right extensions 14, 16 over the front of the shoulders. With left and right hands on the left and right extension 14, 16, respectively, the user rotates the upper body right and left about the spine. The upper body is accelerated to a speed and decelerated to a stop, after which is it accelerated in an opposite direction to a speed and then decelerated to a stop. The weight of the upper body tends to continue moving, stressing and stretching the muscle groups which return the body in an opposite direction.

In rotational movement, torque is equal to a moment of inertia multiplied by angular acceleration. This relationship is the rotational analogue to Newton's second law of motion in rectangular coordinates: Force is equal to mass times acceleration. However, the moment of inertia of any object about an axis is defined by the mathematical integral of radius squared multiplied by a differential mass integrated over the entire mass of the object.

The effect of this relationship defining the moment of inertia is twofold for the bar 10. The moment of inertia is increased as the square of the radius at which weight is placed away from the center of rotation. In addition, weight can be distributed along the length of the left and right extensions 14, 16 inside the bar inside diameter 46. In such a distribution, the moment of inertia is proportional to the third power of a fractional change in length 58 of bar 10. If bar 10 has a weight-per-unit length, then the moment of inertia increases as the cube of a fractional increase in length 58.

The practical effect of the second and third power dependencies of moment of inertia on length is that a small increase in weight and length of bar 10 is substantially more effective than a simple increase of mass. Most of the torso of an average person is within eight inches of the spine and arms are within 9 inches. The torso thus has an effective radius of gyration (effective radius at which the mass is located for purposes of angular momentum calculations) of less than 6 inches. An ounce of mass gained by extending the bar at its maximum length has the effect of more than two pounds of body mass at the radius of gyration in the torso of the body. These figures are approximate since body sizes differ.

This represents the marginal difference due to adding additional weight near cap 20. As with the body, mass of the bar 10 located near the axis of rotation is less effective. Nevertheless, two and one half cubic inches of lead at One end 60, 62 of a bar 10 having a length 58 of six feet of bar 10 is approximately as effective as 35 pounds of body weight rotated at the radius of gyration of the torso.

Thus, a substantial feature of the invention is an ability to load the cavity 56 with weight means 18. In the preferred embodiment, the bar 10 is six feet long, the arm span of a person about six feet tall. An additional advantage of the bar is that the hands and arms can be extended in rigid relationship to the body by sliding the hands out to left end 60 and right end 62. Thus, the effective moment of inertia of the upper body can be increased by distributing the weight of arms and hands along bar 10 at maximum distance from the center of rotation.

This is substantially better than a simple torso twist with the arms extended in free space since the bar 10 assures that the entire upper torso must remain as a more-or-less rigid unit. That is, hands and arms in free space would tend to wave and move inward, substantially reducing their contribution to an increased moment of inertia and angular momentum of the upper body. Several embodiments of weight means 18 may be configured for use in bar 10. Caps 20 may be made to seal cavity 56 in bar 10. If bar 10 is filled with water and sealed with caps 20, the entire bar 10 is increased substantially in weight along the entire length 58.

Figure 2:
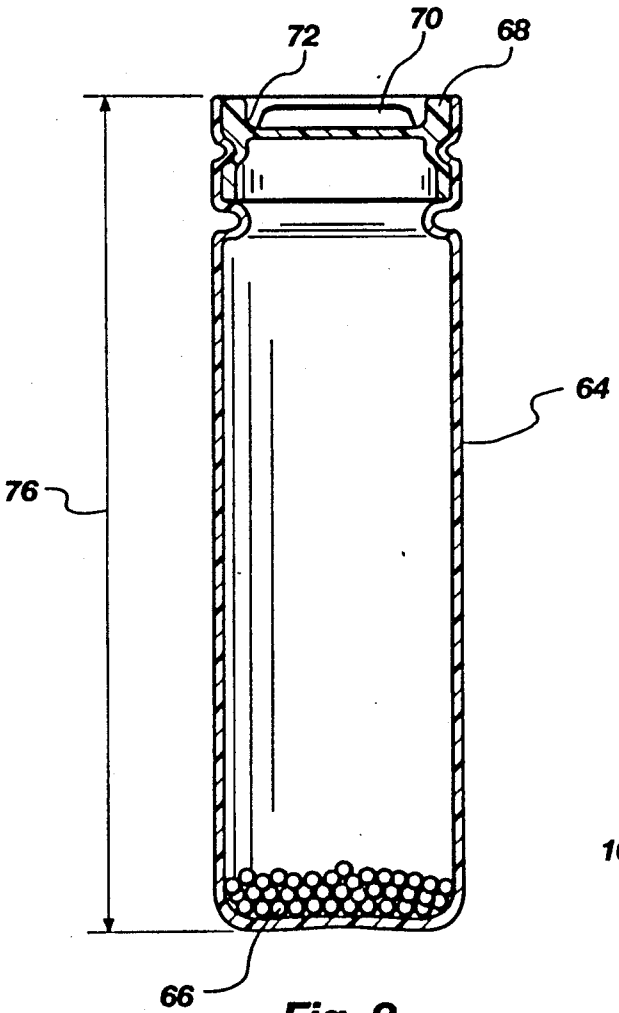
FIG. 2 is a sectioned elevation view of a weight container for use in the bar of FIG. 1.

Some users may prefer to add weight means 18 which is substantially heavier than water. To this end, several configurations may be adopted to add other weights. For example, FIG. 2 shows a shot container 64, which may be blow-molded of polyethylene or other inexpensive polymers. Shot container 64 may be filled with shot 66 made of lead or steel and commercially available. Shot 66 is retained within shot container 65 by shot cap 68 shown in FIG. 2–4. The configuration of FIGS. 2 and 3 have a pull tab 70 which fits into a recess 72 in shot cap 68 to give a flush profile to shot container 64. In the shot cap 68 of FIG. 4, a knurled edge 74 configured to be graspable by the fingers of a user effectuates removal of shot cap 68 from shot container 64. Length 76 of shot container 64 may be made in various sizes, preferably of binary multiples of one another. That is, a one-pound, two-pound, four-pound, etc. selection of shot container 64 may be used to achieve any combination of weights within increments of the smallest increment available.

Figure 5:
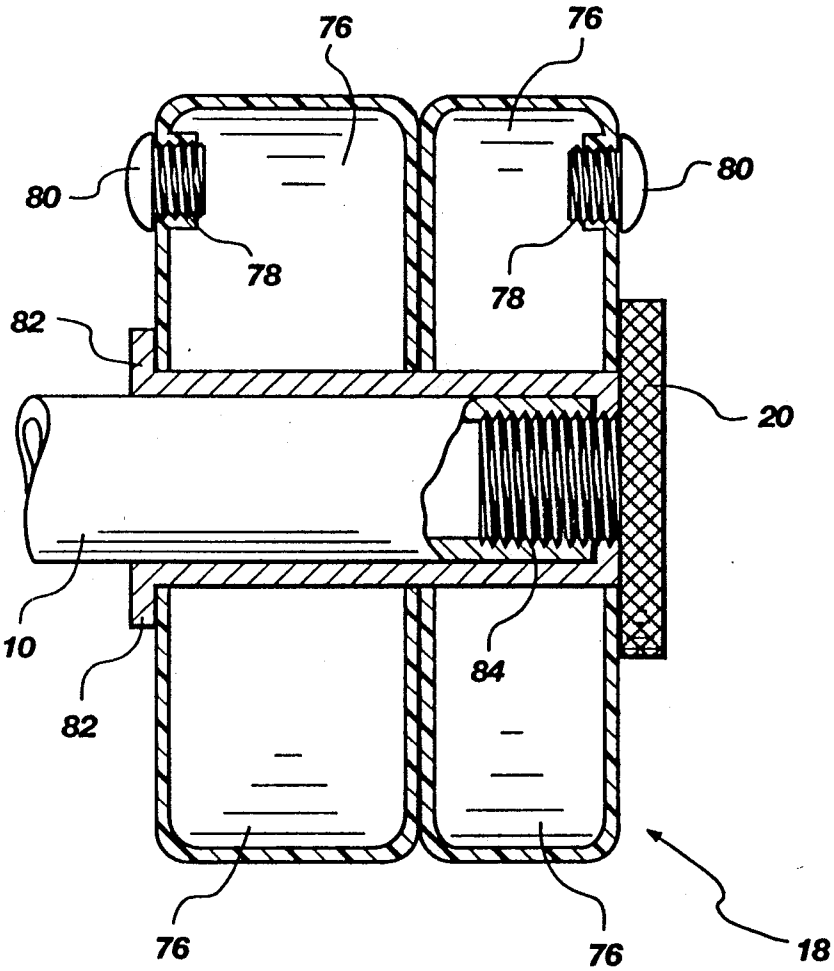
FIG. 5 is a partial cutaway elevation view of filled weights on the bar of FIG. 1.

FIG. 5 shows an alternate embodiment wherein additional means 18 can be added external to bar 10. Water wheels 76 can be filled with water or shot through apertures 78 and sealed by plugs 80. Sleeve 82 fits over bar 10 where it is retained by cap 20 which is secured to bar 10 by threads 84. Water wheel 76 can be blow-molded of polyethylene or other suitable polymers inexpensively to precise volumetric requirements. A significant advantage of the water wheels 76 of FIG. 5 is that they may be carried in the empty condition by a user or a carrier who is shipping them, for minimum weight. As discussed above, one pint of water, weighing a pound, positioned at the extreme end of bar 10 can have the effect of over 30 pounds of body weight in torso twisting exercises. In addition, increasing the speed of exercises proportionally increases the amount of muscle force required to reverse the direction of rotation in the oscillating torso twisting motion.

Figure 6C:
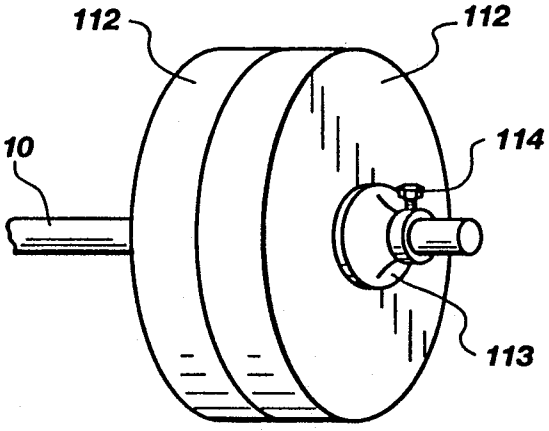
FIG. 6C is a perspective view of barbell dead weights attached to the bar of FIG. 1.
Figure 6D:
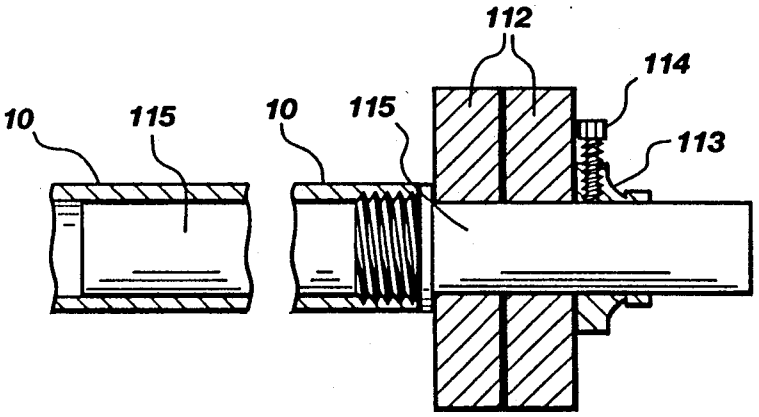
FIG. 6D is a section view of dead weights attached to the bar of FIG. 1 by means of inserts threaded into the bar.
Figure 6A:
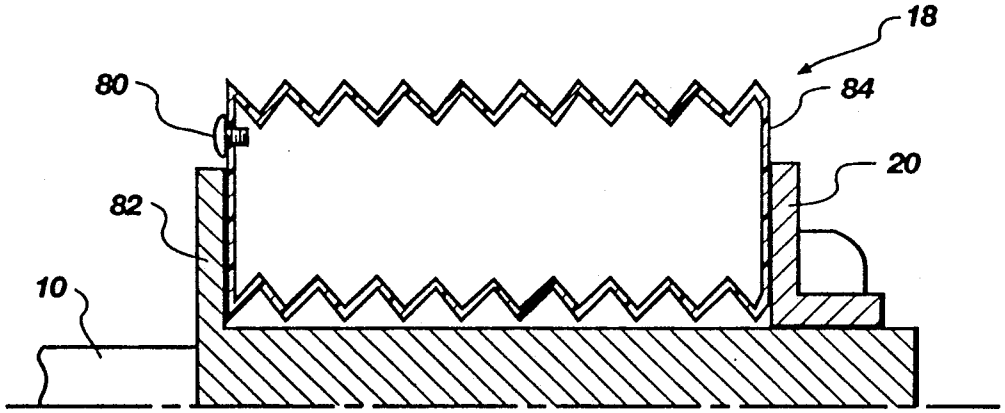
FIG. 6A is a cutaway elevation view of the top half of an adjustable filled weight on the bar of FIG. 1.

FIG. 6A shows a view in cross section of one symmetric half of an accordion-like expandable bottle 84 retained on bar 10 by sleeve 82 and cap 20. Manufacturing expanded bottle 84 must accommodate the convoluted shape. Expandable bottle 84 has the benefit of having adjustable volume. Thus, expandable bottle 84 can be carried in a compressed condition and expanded only when filled with water. The plug 80 seals expandable bottle 84.

In addition the bar 10 is strong enough that metal or similar solid dead weights may be attached like the disks of barbells. This is useful at home or in a spa. Water minimizes travelling weight in the preferred embodiment, however.

Figure 6B:
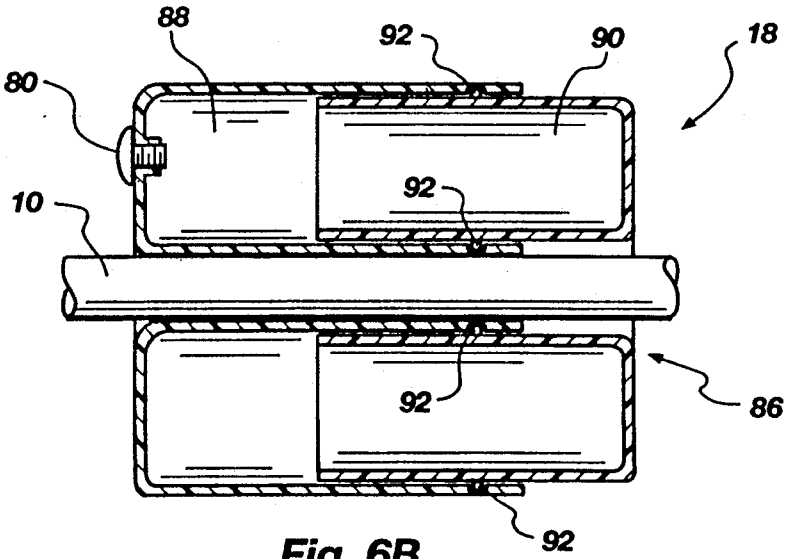
FIG. 6B is a cutaway elevation view of an adjustable filled weight on the bar of FIG. 1.

A sliding bottle 86 is shown in FIG. 6B, wherein first cup 88 slides over second cup 90 in sealed contact due to seals 92. An added advantage of the sliding bottle 86 is that the first and second cups 88, 90 can be emptied and inverted to take less space for storage. In fact, if plug 80 were pulled, then sliding bottle 86 can be emptied simply by pulling the first and second cups 88, 90 apart. The major importance of additional weight means 18 attachable at the left and right ends 60, 62 of bar 10 is to increase the moment of inertia. One importance of water-filled systems to add weight is the improved expense and convenience for manufacturing, shipping and traveling.

As shown by FIG. 6C, dead weights 112 such as are used in barbells can be secured by similar means. Retainers 113 using set screws 114 can be used if bar 10 is made of steel, but other means such as the sleeve 82 of FIG. 6B is preferred if bar 10 is of aluminum.

FIG. 6D shows an insert 115 threadedly engaged in bar 10 in place of end caps 20. The insert 115 is a rod for retaining dead weights 112. The insert 115 is removable with the dead weights 112 and retainer intact. The insert 115 extends into bar 10 sufficient distance so that the bar and insert carry the load, and the threaded engagement is only for preventing insert 115 from sliding out of bar 10.

Figure 7:
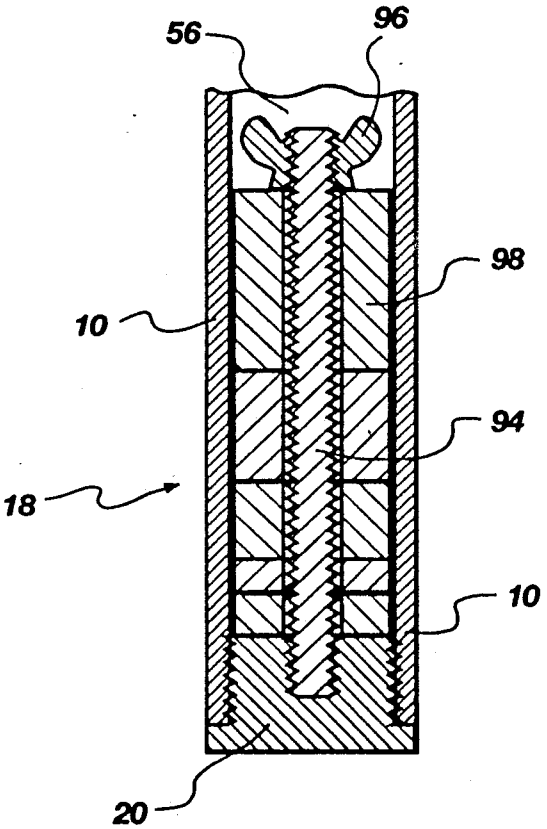
FIG. 7 is a cutaway top view of dead weights attached to an end cap in the bar of FIG. 1.

In situations where carrying weight is not significant, the weight means 18 of FIGS. 7–11 are of equal utility and higher weight than water. In the configuration of FIG. 7, the cap 20 is configured for threaded connection to bar 10 with a post 94 secured thereto. By means of a wing nut 96, weight slugs 98 can be secured to post 94 and cap 20.

A combination of weight slugs 98 in binary combinations would serve to allow any combination of weights. Each size of weight slug 98 is double the weight of the next smaller size. Any weight up to the total of all weight slugs 98 could be arranged in increments of the smallest unit weight available. Total mass or weight can be substantial if weight slugs 98 are made of lead secured in the cavity 56 of bar 10. At a specific gravity greater than 11 times that of water, lead might be configured in one, two, four and eight pound weight slugs 98. Any combination between one pound and 15 pounds per side may be installed in the cavity 56 of bar 10.

Figure 8:
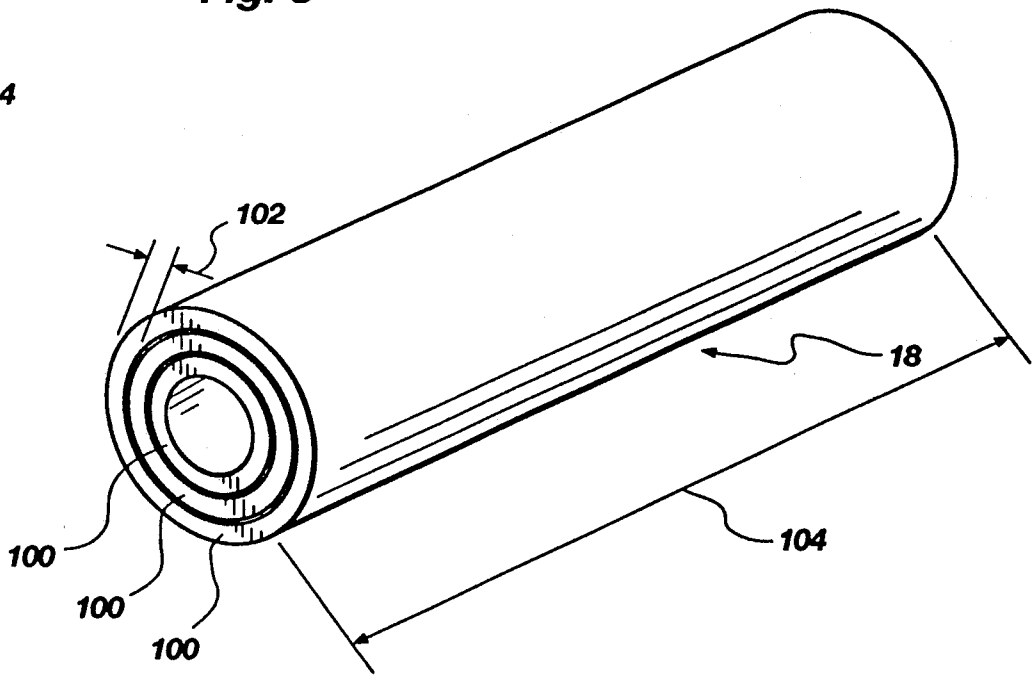
FIG. 8 is a perspective view of annular weights which may be configured to fit inside or outside the bar of FIG. 1.
Figure 10:
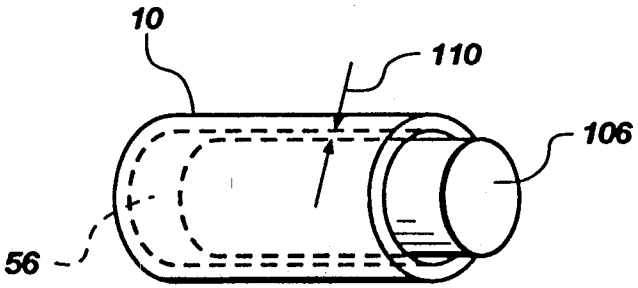
FIG. 10 is a perspective view of one end of the bar of FIG. 1 showing spacers with a clearance for easy insertion into and removal from the bar.

Alternatively, the caps 20 of FIG. 1 or FIG. 7 can be used with annular weights 100 of FIG. 8. The annular weights 100 can be made of the same or different wall thickness 102 to control the incremental weight of each annular weight 100. The length 104 would be constant for all annular weights 100. Annular weights 100 necessarily have to be installed beginning with the outermost diameter first. Spacers 106 may be installed in the cavity 56 of bar 10 if the length 104 of annular weights 100 does not reach to the natural blockage created by second radius 42 and third radius 43. Spacers 106 can be made of lightweight material such as expanded polyethylene or polystyrene. As shown in FIG. 10, spacers 106 require a clearance 110 to ensure that they are readily removable from cavity 56. Spacers 106 can be removed as corresponding lengths of annular weights 100 are added.

The annular weights 100 of FIG. 8 can be conformed to fit inside or outside of bar 10. If outside the bar outside diameter 44, some means of retention such as friction or a sleeve 20 of FIG. 6A may be required. The annular weights 100 may be configured to retain each other in a nested configuration. For example a flange on the end closest to yoke 12 may prevent each size from moving with respect to the next size down. End caps 20 may be of a size to prevent annular weights 100 from slipping off of bar 10.

Figure 9:
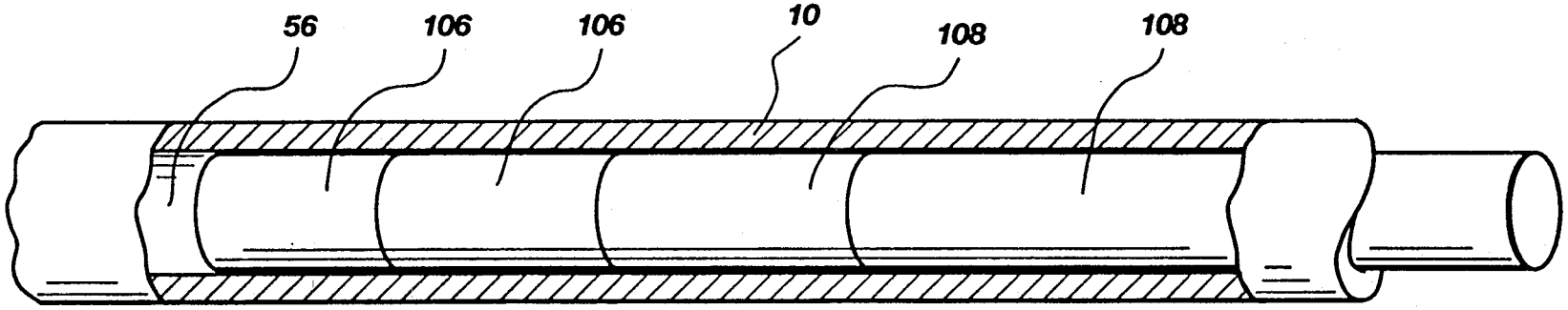
FIG. 9 is a cutaway perspective view of the bar of FIG. 1 containing weights and spacers inside.

Alternatively, cylindrical weights 108 of various lengths can be inserted into the cavity 56 of bar 10 as shown in FIG. 9. In this way, all weight used can be adjusted along the length 58 of bar 10 to give the desired moment of inertia of bar 10 at the desired total weight. Thus, spacers 106 in FIG. 9 can be closer to cap 20 (see FIG. 1) or closer to second and third radii 42, 43.

Figure 11:
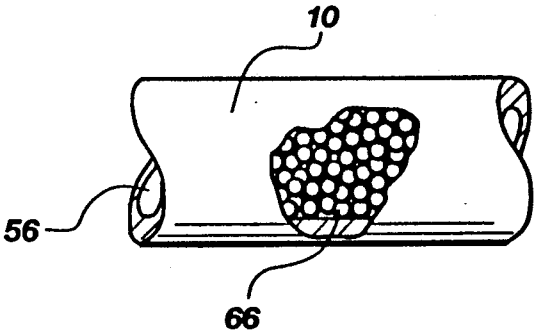
FIG. 11 is a cutaway perspective view of a portion the bar of FIG. 1 holding shot as extra weight means.

Just as bar 10 can be filled with water or a simple, portable weight means 18, the cavity 56 of bar 10 can be completely filled with loose shot 66 as shown in FIG. 11. The caps 20 in FIG. 1 retain the shot 66 within the bar 10. Of course, shot 66 completely filling bar 10 creates a very heavy exerciser useful for numerous exercises. However, the bar 10 is not highly portable nor adjustable in such a configuration. Thus, the preferred embodiment for a particular user will depend on the user's size, circumstances and mobility, among other factors.

The highly functional cap 20 may be designed in one of several embodiments displayed in FIGS. 12–20. The cap 20 in FIG. 12 Comprises a stop 120 and a core 122. The core 122 fits inside bar 10 to snugly seat within the bar inside diameter 46 by means of 'O' ring 124. 'O' ring 124 serves to create friction to hold cap 20 and to seal liquids within the cavity 56 of bar 10.

Figure 14:
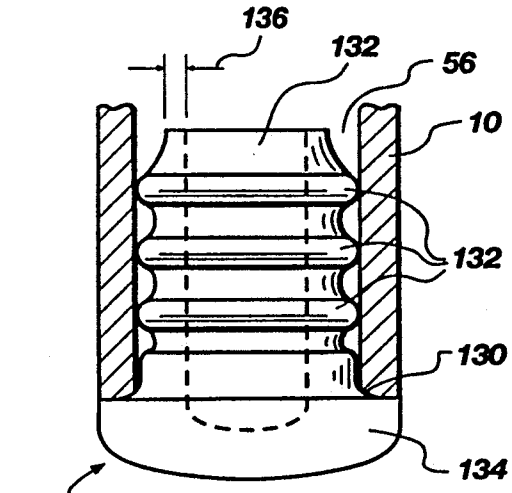
FIG. 14 is a top view of a molded cap inside the sectioned end of the bar of FIG. 1.
Figure 13:
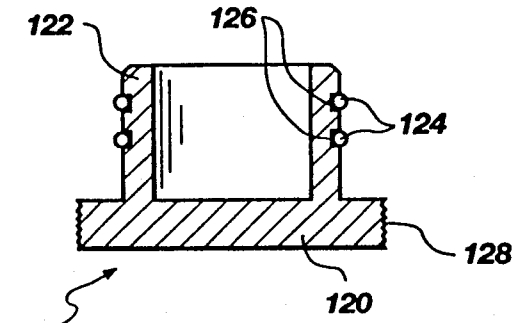
FIG. 13 is a sectioned top view of an end cap using double 'O' rings.

FIG. 13 shows an embodiment wherein cap 20 uses multiple 'O' rings 24 set in grooves 126 in core 122. In addition, stop 120 is provided with a knurled edge 128 for easier gripping by a user. The embodiment of FIG. 14 does not use separate 'O' rings, but rather uses a single molded cap 20 having a shoulder 130 to prevent cap 20 from penetrating too far into the cavity 56 of bar 10 with ridges 132 functioning as 'O' rings. Nevertheless, cap 20 of FIG. 14 is molded as a single piece from a polymeric preferably elastomeric, compound. Various rubber and plastic products are available for molding. This particular embodiment also has a bumper 134 molded into it. The cap 20 of FIG. 14 may be hollow, the wall thickness 136 of core 122 being designed to minimize required material while optimizing the frictional retention forces and sealing capability of ridges 132.

Figure 15:
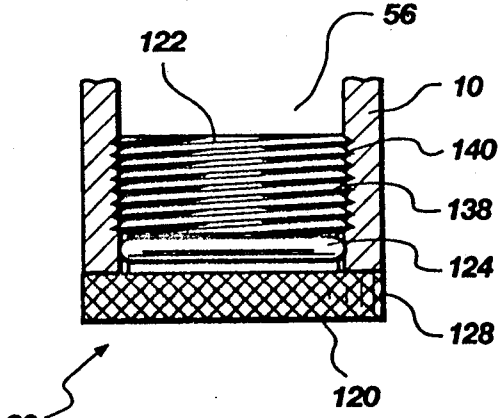
FIG. 15 is a top view of a threaded an knurled end cap in one sectioned end of the bar of FIG. 1.

FIG. 15 shows a cap 20 having a knurled edge 128 on stop 120 for gripping by a user while engaging threads 138 of core 122 with threads 140 of bar 10. 'O' ring 124 provides sealing. Cap 20 of FIG. 15 can be made of metal while 'O' ring 124 must be made of an elastomeric material.

Figure 16:
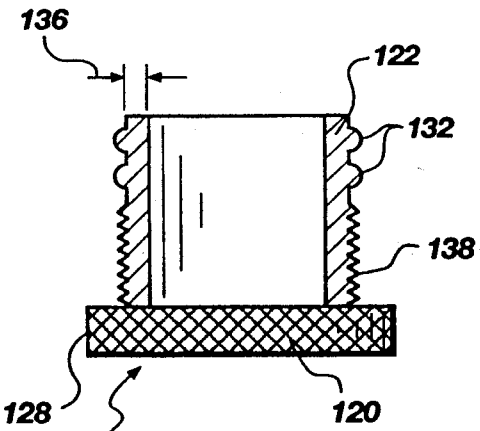
FIG. 16 is a cutaway top view of a molded end cap having threads and ridges to act as 'O' rings.
Figure 12:
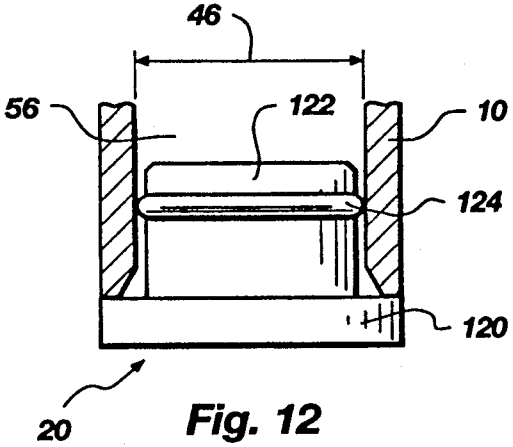
FIG. 12 is a sectioned top view of the bar of FIG. 1 and an end cap having a friction fit with an 'O' ring.

In FIG. 16, cap 20 is configured in a single piece having a knurled edge 128 on stop 120 with threads 138 molded directly with core 122 along with ridges 132 which serve as 'O' rings. As with other embodiments, wall thickness 136 can be designed to optimize weight, material use, and the sealing function of ridges 132.

Figure 17:
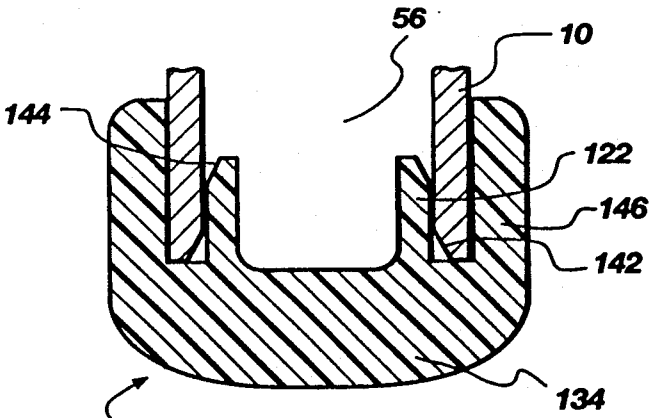
FIG. 17 is a cutaway top view of a molded end cap using inside and outside contact with the end of the bar of FIG. 18 is a top view of a compression end cap.

FIG. 17 shows a cap which uses only friction for retention. The cap 20 has a bumper 134 molded directly to protect both the ends 60, 62 and the outer diameter of bar 10. Also, FIG. 17 shows a chamfer 142 on bar 10 to provide for easier insertion of core 122 into the cavity 56 of bar 10. Likewise, cap 20 has a chamfer 144 for similar effect. The chamfer 142 on bar 10 and chamfer 144 on cap 20 are preferred in all designs of cap 20 for the invention. Core 122 and sleeve 146 of cap 20 in FIG. 17 capture bar 10 between them to provide a seal and a friction fit.

Figure 18:
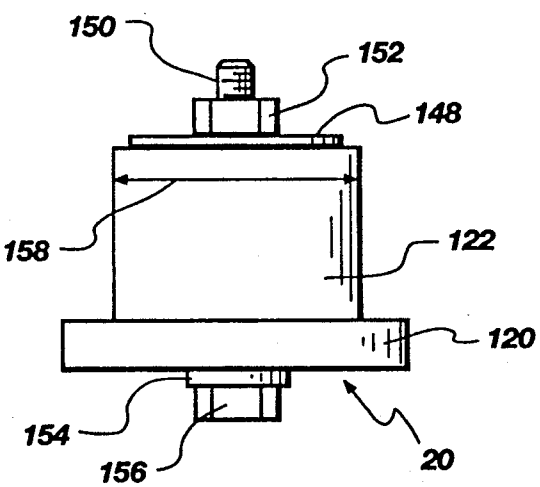

FIG. 18 shows a cap 20 in principle comprising a stop 120, which may be separate from or cast with core 122. Core 122 is of an elastomeric material like latex or urethane. Washer 148 fits within the cavity 56 of bar 10 so that bolt 150 when tightened against nut 152 forces washer 148 closer to washer 154 near head 156 of bolt 150. Diameter 158 of core 122 in cap 20, according to the Poisson effect, must increase as nut 152 is tightened on bolt 150, compressing the elastomeric material of core 122. The increase in diameter 158 creates a high-pressure friction seal against the bar 10. With a properly compliant elastomeric material for core 122, an excellent watertight seal can be created within cavity 56 of bar 10.

Figure 19:
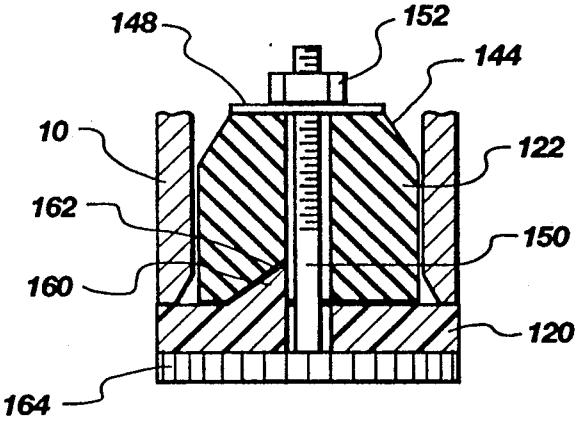
FIG. 19 is a top view partially sectioned to show a readily releasable compression end cap in one end of the bar of FIG. 1.
Figure 20:
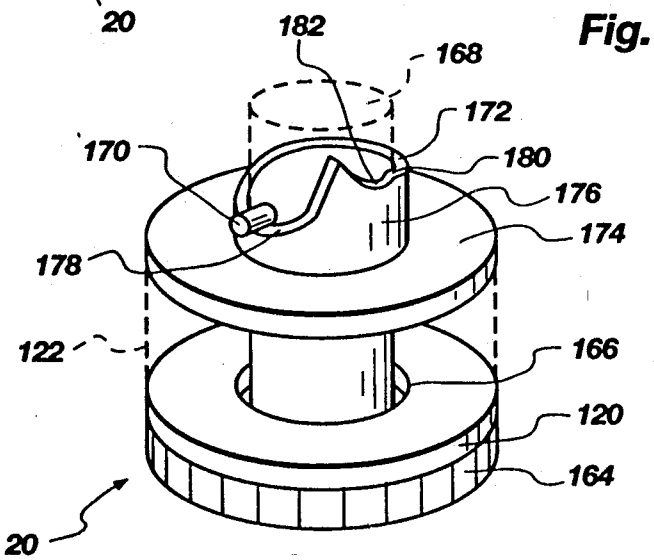
FIG. 20 is a perspective view of the components of a quick release, cam lock design for a compression end cap with the location of the elastomeric core shown in phantom.

FIGS. 19 and 20 show refinements of the concept of FIG. 18. In the configuration of FIG. 19, bolt 150 extends through core 122, which is comprised of an elastomeric material. In addition, stop 120 is secured by spur 160 to prevent rotation between stop 120 and core 122. In the preferred embodiment, spur 160 is formed in triplicate as a part of stop 120 and fits into matching recesses 162 every 120 degrees around in core 122. Wheel 164 is rotated by a user, tightening nut 152 against washer 148, thereby compressing core 122 as in the embodiment of FIG. 18. Chamfer 144 allows easy insertion of core 122 into bar 10 without harming the expansion of core 122 for frictional and sealing purposes against bar 10. Wheel 164 has the advantage of a neat, flush appearance as well as elimination of any tools for tightening and releasing.

FIG. 20 is yet another embodiment of the principals of FIGS. 18 and 19. FIG. 20 demonstrates a wheel 164 penetrating through an aperture 166 in stop 120. The elastomeric core 122 is removed from FIG. 20 and shown only in phantom in order to expose other details. Rod 168 is secured to wheel 164 to turn therewith, penetrating through aperture 166 in stop 120. Pin 170, fixed to rod 168 by welding, insertion, or available fastening techniques, is configured to extend from rod 168 and ride on cam surface 172 as wheel 164 rotates rod 168 with respect to cam plate 174. Cam plate 174 is configured to fit inside bar 10, having a size consistent with core 122 as discussed for previous embodiments. Cam plate 174 is fixedly attached to cam 176 and does not rotate with respect to core 122 and stop 120.

The cap 20 of FIG. 20 is sealed when a user rotates wheel 164 with respect to stop 120, core 122 and cam plate 174. Rod 168 turns with wheel 164, sliding pin 170 along cam surface 172. The proportions of cam surface 172 are slightly exaggerated to show the effect of its profile, but pin 170 rotates along cam surface 172 from low level 178 past detent 180 to high level 182. The detent 180 is simply a slight rise in cam surface 172 above high level 182 which prevents pin 170 from sliding back down cam surface 172 in response to the pressure exerted on cam plate 174 by core 122. The effect of the cap 20 of FIG. 20 is to make a quick release version of the cap 20 of FIG. 18.

Figure 21:
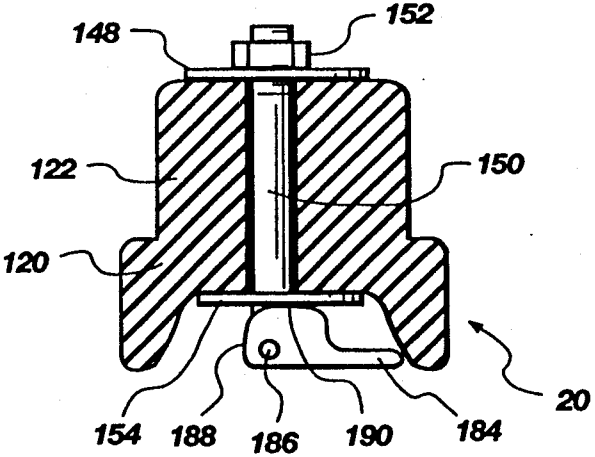
FIG. 21 is a top sectioned view of a lever-actuated quick release end cap.

FIG. 21 shows a lever-type quick release for cap 20. Lever 184 pulls pin 186 attached through bolt 150. As lever 184 rotates between a low edge 188 and a high edge 190, pin 186 moves closer or further from washer 148 at nut 152 on bolt 150. Stop 120 and core 122 may be cast of a single block of elastomeric material which is compressed between washer 148 and washer 154. Core 122 expands to make a friction fit and a watertight seal against bar 10 when lever 184 is positioned with high edge 190 against washer 154. Core 122 is restored to its original shape when lever 184 is pulled out, thus turning to place low edge 188 against washer 154. Bolt 150 is preferably centered within core 122 but need not necessarily be so positioned.

Figure 22:
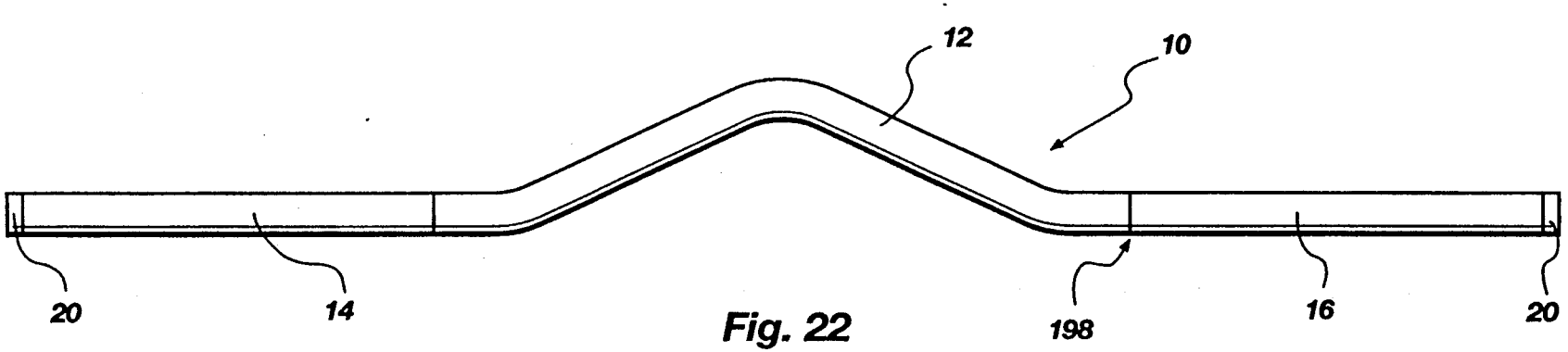
FIG. 22 is a top view of the bar of the invention configured in a segmented configuration for takedown.
Figure 23:
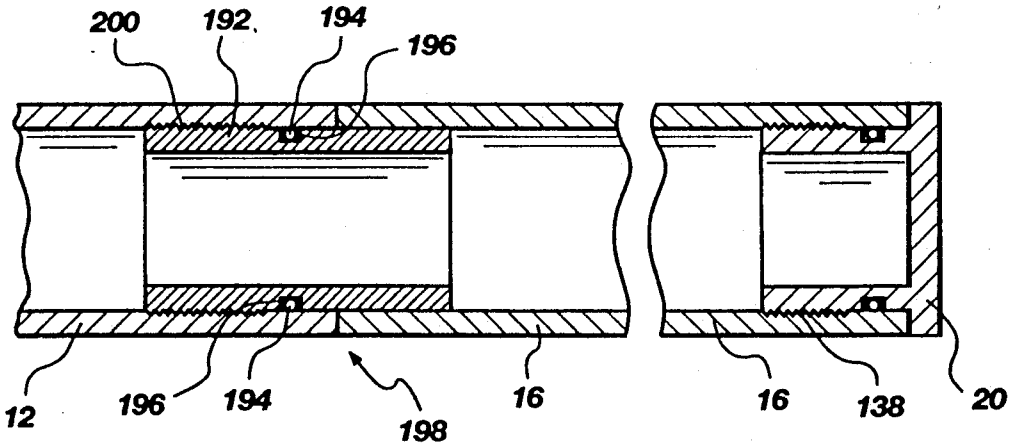
FIG. 23 is a top sectioned view of a segment of the bar of FIG. 22 showing connections at the joints and end caps.

FIG. 22 shows the bar 10 configured such that left extension 14 and right extension 16 are separable from yoke 12. This knock-down configuration is further shown in FIG. 23 where yoke 12 connects to right extension 16 by means of sleeve 192 which is rigidly attached to one member, right extension 16 in this case, and is threadedly attached to the other member, yoke 12 in this case. A seal 194 fits into a seal groove 196 for a joint 198 which is mechanically strong and watertight. If threads 200 of sleeve 192 match threads 138 of cap 20, then right extension 16 can be made in various lengths to change the length of a bar. For example, instead of a single right extension 16, a plurality of extensions could be fabricated of varying lengths. Such a configuration aids both portability and adjustability. FIG. 24 shows bar 10 broken down into yoke 12 with two right extensions 16 and two left extensions 14.

Referring to FIG. 25, bar 10 could be fit into a carrying case 202 having extension pockets 204 and a yoke pocket 206. Pockets for an instruction book, exercise manual, gym clothes or other equipment may be made into carrying case 202. The carrying case 202 can be folded as shown in FIG. 25 where flap 208 sealed with closure 210 against flap 212 makes a small package which can be carried by handle 214.

FIG. 27 shows a rack system 22 comprising a strap 216 fitted through a slot 218 in rack 220. An additional aperture 222 can be used for hanging rack 220 for storage on a wall hook.

Figure 28:
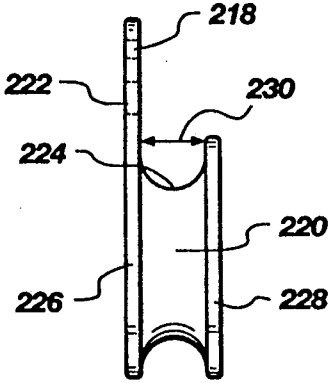
FIG. 28 is a side view of the rack of FIG. 27.

FIG. 28 shows rack 220 in a side view with a hollow 224 formed in rack 220 to hold bar 10. Bar 10 is retained between rear flange 226 and front flange 228. Clearance 230 may be manufactured to be sightly narrower than the hollow 224 in general. Thus, clearance 230 is configured to allow front flange 228 and rear flange 226 to form a detent effect retaining bar 10 within hollow 224.

FIG. 29 shows an alternate configuration of strap 216. An adjustable buckle 232, which may or may not be removable for insertion of strap 216 through slot 218 in rack 220, is used to adjust the length of strap 216. An eye bolt 234, which might be replaced by a fastener of another configuration, is used to attach strap 216 to an overhead support.

Thus, bar 10, when fitted into rack 220 suspended from an overhead support by eye bolt 234 and strap 216, can be adjusted by adjustable buckle 232 to form a bar for various exercises. Vertical chin ups or pull ups are possible, or a body lift with the body rigid on the floor and the arms pulling against the bar above. Meanwhile, rack 220 forms a storage holder to suspend the bar 10 from a wall hook when not in use.

A user prepares bar 10 by doing several optional tasks. Depending on the configuration, bar 10 may need to be assembled from components as shown in FIGS. 22–26. The components may be removed from a carrying case or luggage for assembly. Following assembly, a user removes one or both caps 20.

To increase the weight of bar 10, a user fills cavity 56 of bar 10 with water, shot or other weight means 18. Also, depending upon the configuration available, a user may add additional weight means 18 by the use of shot container 64 of FIG. 2, water wheels 76 of FIG. 5, expandable bottle 84 of FIG. 6A or sliding bottle 86 of FIG. 6B. In lieu of using shot 66 free within bar 10 or water within bar 10, weight means 18 can be added inside bar 10 by weight slugs 98 shown in FIG. 7, annular weights 100 shown in FIG. 8 or dead weights like barbells use.

To adjust the moment of inertia of the bar 10 to the desired value, spacers 106 may be inserted into the cavity 56 of bar 10 before adding shot containers 64, weight slugs 98, cylindrical weights 108 or annular weights 100. Spacers 106, as shown in FIG. 9, may be placed nearer to yoke 12 or nearer to caps 20 to adjust the position as well as the amount of weight comprised in weight means 18 inserted into the cavity 56 of bar 10. After inserting proper weight means 18, a user applies cap 20 to any open end 60, 62 of bar 10. Cap 20 may be slidingly fitted or threadedly connected to bar 10 according to the configuration used. (See FIGS. 12–21 for cap configurations, with connection and sealing means.)

The bar 10 can be used in a variety of exercises. The principle mode of using bar 10 is accomplished by placing the yoke 12 behind the neck of a user with the left hand on left extension 14 and the right hand wrapped around right extension 16, arms fully extended. Left and right extensions 14, 16 extend outward across the left and right shoulders, respectively. In a basic exercise, a user twists at the waist, swinging the entire upper torso with bar 10 in oscillating motion. Caps 20 of bar 10 oscillate within a circle centered at the spine.

Side bends start with a user's arms extended over the top of left and right extensions 14, 16. A user bends from side to side such that end caps 20 oscillate in approximately vertical circles centered at the waist.

Seated twist exercises are similar to standing twists from a seated position. Bar 10 is rotated so that caps 20 oscillate forward and backward in a circle centered about the spine while the arms are extended over the left and right extensions 14, 16, respectively, or the hands may grip left and right extensions 14, 16 close to yoke 12.

Toe-to-toe twists are done with a user bending at the waist, the yoke behind the neck with the left and right arms extended over the left and right extensions 14, 16, respectively. A user twists at the waist with the upper torso leaning approximately horizontally. The hands and the end caps alternately move toward the toe of the opposing foot. Thus, right hand approaches left foot following which the left hand approaches the right foot, etc. In another version of this exercise, a user returns to a full upright position before reaching toward a foot with the hand and bar 10.

An upright twist is done by leaning back with the head upward and the arms extended over the left and right extensions 14, 16, respectively. With the muscles of the lower torso supporting the upper torso in its tilted position, the caps 20 of the bar 10 are oscillated in a circular plane by the hands extended along left and right extensions 14, 16.

The bar 10, properly augmented with weight means 18, can be used for standard bar curls utilizing the wrists as the only rotating motion. Left and right extensions 14, 16 are gripped by left and right hands, respectively, with yoke 12 pointing downward. Bar 10 is then rotated to lift yoke 12 from a downward position to an upward position.

Alternatively, a user may grip yoke 12 with the left and right hand on the first and second legs 47, 49 of yoke 12 such that the left and right extensions 14, 16 are furthest from the body. The wrists are curled upward and downward against the weight of bar 10 accentuated by the lever arm of yoke depth 50 which leverages the weight of bar 10 for the exercise.

Bicep curls using the biceps to curl the bar are also done in similar manner. Again, the weight of bar 10 can be leveraged by gripping the bar 10 by yoke 12.

From a seated position or a lying position on the stomach, bar 10 may be gripped by left and right extensions 14, 16 close to yoke 12 and pushed away from the body. This same exercise can be conducted from a standing position. In addition, in a standing position, a user may throw the bar outward. The bar may be held outward away from the body or may be allowed to fall inward to the thighs.

Single hand curls can also be done. Gripping yoke 12 at first radius 40, curls can be done with a wrist or with a bicep. Bar 10 may be allowed to slip in the hand at first radius 40. The dead weight of bar 10 is the only effective weight in this case. If yoke 12 is gripped in a horizontal position by a gloved hand, the additional leverage of yoke depth 50 greatly multiplies the effective weight of the weight means 18 of bar 10.

The bar 10 may be used as a weight or balance during squats to exercise quadriceps. With left and right extensions 14, 16 extending out between biceps and forearms, the hands may hold yoke 12. Yoke 12 may be oriented to point downward or upward. Hands may grip the yoke on the same side of the body as the hand or on the opposing side of the body. Additional balance may be achieved by extending the arms and holding yoke 12 such that left and right extensions 14, 16 are substantially beyond the knees in the squat position. Thus, a squat can be deeper, stretching muscles further because additional balance is available which is not available in squats done without the counterbalancing weight of bar 10.

Regular squats may also be done with the bar 10 positioned with yoke 12 over the neck and left and right arms extended over left and right extensions 14, 16, respectively, the standard position. This position prevents the upper torso from bending over the knees but maintains an erect posture as well as adding additional weight.

Half-squat exercises can be done by holding the left extension 14 in front of the body with the right extension 16 behind the body and the yoke 12 between the knees. A user must maintain erect posture due to the geometric relation of the arms and the bar 10. The user then squats to a halfway position between standing and sitting on the calves. This same exercise may be done with the arms in reverse positions. This exercise may also be done with a full squat wherein the thighs come to rest on the calves.

Balance and strength can be improved by lunge exercises holding the bar 10 in the standard position. The standard position places the yoke 12 over the neck with left and right extensions 14, 16 extending across the top front of the left and right shoulders, respectively. Stepping exercises and lunging exercises backward and forward can be done in this posture.

Stiff-leg deadlifts, as well as the lunging and stepping exercises, can tone the hamstrings. If a user bends at the waist keeping the legs straight, similar to stretching calisthenics, with bar 10 held in a position near the floor, the moment of inertia of the torso which effectively exercises the left and back muscles in lifting the upper torso upright is enhanced.

A similar but slightly different effect can be achieved with a user holding left and right extensions 14, 16 in left and right hands, respectively, with the arms extended parallel to the spine beyond the top of the head, while the user stands, with straight legs, bent at the waist, the upper torso is horizontal. In this position, the additional leverage of bar 10 is substantial. Particularly if this exercise is done with enough repetitions and a high enough speed, the extended bar greatly multiplies the effective rotational moment of inertia of the upper torso about the hips.

For exercising the latissimus dorsi and other upper back muscles, a running motion or a rowing motion with the torso bent over horizontally at the waist can be done with the bar 10 in the standard position.

Calves are exercised by raising the body on the toes or by raising the knees in a seated position on the toes. Holding bar 10 in the standard position while doing toe raises maintains proper extension and exercise of the muscles in the calves.

The trapezius and other muscles associated with the shoulder can be exercised using shoulder shrugs, with the bar in the standard position. With the bar held in front of the body, the bar can be lifted with the hands in front of the bar or the hands behind the bar using it as a deadweight for close grip 'V' pulls or straight-arm deltoid lifts. The bar can also be used in behind-the-neck presses. The bar is lifted above the head. By placing the hands as far out on left and right extensions 14, 16 as possible, additional leverage is achieved in the muscles, since they operate at a joint with a leverage disadvantage against an extended arm.

Several lower back exercises are enhanced by the use of the bar 10. With the bar held in the standard position, the user bends at the waist and then straightens up. This exercise is repeated. The higher the speed at which this exercise is conducted, the more substantial it is. Since the bar 10 is weight applied at the extreme distal end of the torso from the point of bending, its weight is substantially multiplied as described above. That is, the moment of inertia increases substantially more than the simple weight addition to the body.

A variation of the bending exercises is conducted by a user holding the bar 10 in the standard position. The user bends to one side, then swings around to the front and on to the other side of the body and then straightens up. These exercises can be done in either direction. The bar 10 moves from a horizontal position to an approximately vertical position and then swings around the body with the turning of the upper torso and returns again to the horizontal position when the user stands upright.

Another lower back exercise, the bent-knee deadlift, is done by bending at the waist, holding the yoke 12 of bar 10 by the yoke 12 with the left and right extensions 14, 16 on the floor. With the arms fixed relative to the torso, the body is rotated at the knees to a seated posture lifting the bar 10. The arms remain extended away from the chest. As the body rotates about the knees, the torso and thighs rotate together to leave the body in a squatting position. Then, the knees are straightened and the user straightens to a standing position. Again, the conduct of this exercise at a very slow speed builds strength as the bar 10 adds its weight and leverage which must be held over a long period of time. Done in a rapid manner, the bar 10 adds its weight to the moment of inertia which resists angular accelerators.

This disclosure does not articulate the full scope of the embodiments which may comprise the invention. The best mode contemplated for practicing the invention as shown in the embodiments herein may be altered with obvious variations by those having ordinary skill in the art.

Therefore, without limiting the invention to the embodiments described herein, What is claimed is:

1. An apparatus for use in the performance of exercises, said apparatus comprising:

a yoke for supporting said tube on the users neck; said yoke further comprising:

an arcuate portion;

a straight right leg extending from a right end of the arcuate portion and having a length greater than half the length of the arcuate portion;

a straight left leg extending from a left end of the arcuate portion and having a length greater than half the length of the arcuate portion;

a left extension extending away from said yoke for holding the user's shoulders in a neutral position when grasped by a user; and a right extension extending away from said yoke in a direction opposite to said left extension and parallel thereto for holding the user's shoulders in a neutral position when grasped by a user.

2. The apparatus of claim 1 further comprising:

a cap snugly fitted to an inside surface of said tube for containing a material therein.

3. The apparatus of claim 2, wherein said cap is further provided with retaining means for attachment inside said tube.

4. The apparatus of claim 3, wherein said retaining means is thread means for engagement of the inside surface of said tube by said cap.

5. The apparatus of claim 2, wherein said retaining means includes the inside surface of the tube and an outside surface of the cap assembled to have an interference fit for creating friction therebetween.

6. The apparatus of claim 2, wherein said cap further comprises seal means for sealing against a rigid surface of said tube for holding a liquid inside said tube.

7. The apparatus of claim 6, wherein said seal means is comprised of n elastomeric material positioned to be in intimate contact with the circumference of the inside surface of the tube.

8. The apparatus of claim 7, wherein said seal means is an 'O' ring.

9. The apparatus of claim 2, wherein said cap means is further comprised of bumper means having a high energy absorption and configured to protect objects from damage when contacting said tube.

10. The apparatus of claim 1 further comprising weight means secured proximate said left and right extensions for increasing the moment of inertia of said tube.

11. The apparatus of claim 10, wherein said weight is configured to fit inside said tube means.

12. The apparatus of claim 11, wherein said weight means is water.

13. The apparatus of claim 10, wherein said weight means is shot.

14. The apparatus of claim 10, wherein said weight means is configured for assembly in multiples of an incremental weight.

15. The apparatus of claim 10, wherein said weight is configured to lift outside an outer surface of said tube means.

16. The apparatus of claim 1, wherein said tube is configured for assembly from and disassembly into sections.

17. The apparatus of claim 1, wherein said arcuate portion has a first radius of between 3 to 7 inches, wherein said left extension further includes a left arcuate portion connected to said yoke and having a radius of between 3 and 6 inches, and wherein said right extension further includes a right arcuate portion connected to said yoke and having a radius of between 3 and 6 inches.

18. The apparatus of claim 17, wherein a first angle between said left leg and said right leg measures between about 100 and 150 degrees and wherein a second angle between said left extension and said left straight leg and a third angle between said right extension and said right straight leg are coplanar with each other and with said first angle.

19. The apparatus of claim 1 further comprising a cap for securing a weighting material to the apparatus.

20. The apparatus of claim 19, wherein the cap is further provided with a threaded connection for securing the cap to the apparatus.

21. The apparatus of claim 19, wherein the cap is configured to be secured to the apparatus by friction.

22. The apparatus of claim 19, wherein the cap further comprises a seal for containing the weighting material.

23. The apparatus of claim 22, wherein the seal is comprised of an elastomeric material.

24. The apparatus of claim 22, wherein the seal is an 'O' ring.

25. The apparatus of claim 19, wherein the cap further comprises a bumper for protecting objects contacting the apparatus.

26. A tube for use in the performance of exercises, said tube comprising:

a yoke for fitting behind a user's neck;

a left straight leg extending from the yoke for extending across the user's shoulder and having a length greater than half the length of the yoke;

a right straight leg extending from the yoke for extending across the user's shoulder and having a length greater than half the length of the yoke;

a left extension having a length and extending from the left straight leg for grasping by the user along the length thereof while the user's shoulders remain in a neutral position;

a right leg extension having a length and extending from the right straight leg for grasping by the user along the length thereof while the user's shoulders remain in a neutral position; and said left extension having a centerline extending along the length thereof, said centerline being parallel to a centerline extending along the length of the right extension.

27. The tube of claim 26 further including:

said left extension including a left arcuate portion connecting a left straight portion to said left straight leg for positioning said left straight portion in front of the user's left shoulder; and said right extension including a right arcuate portion connecting a right straight portion to said right straight leg for positioning said left straight portion in front of the user's right shoulder.

28. The tube of claim 27 further including:

a first angle between the left straight leg and the right straight leg measuring between 100 and 150 degrees;

a second angle between said left straight leg and said left straight portion measuring between 115 and 130 degrees; and a third angle between said right straight leg and said left straight portion equal to said second angle.

29. An exercise device comprising:

a yoke for fitting behind the user's neck, said yoke comprising:

a central arcuate segment formed in said yoke for fitting behind the user's neck during the performance of exercises;

a first straight segment attached at one end to a left end of said central arcuate segment and extending to a length greater than half the length of the central arcuate segment and; and a second straight segment attached at one end to a right end of said central arcuate segment and extending to a length greater than half the length of the central arcuate segment and;

a left arcuate segment attached at a first end to another end of said first straight segment for extending away from said yoke;

a right arcuate segment attached at a first end to another end of said second straight segment for extending away from said yoke;

a left extension attached at a proximal end to a second end of said left arcuate segment for extending away from the user's left shoulder; and a right extension attached at a proximal end to a second end of said right arcuate segment for extending away from the user's right shoulder

30. An apparatus for performance of exercises by a user, said apparatus comprising:

a yoke formed in an arc proximate the middle of said apparatus for fitting behind the user's neck;

a left arm having a length greater than half the length of the yoke and attached to a left side of said yoke for extending straight away therefrom;

a left elbow attached to a left end of said left arm for curving laterally in front of the user's left shoulder;

a left extension attached to a left end of said left elbow to extend away therefrom for maintaining the user's shoulders in a neutral position when grasped by a user;

a right arm having a length greater than half the length of the yoke and attached to a right side of said yoke portion for extending straight away therefrom;

a right elbow attached to a right end of said right arm for curving laterally in front of the user's right shoulder; and a right extension attached to a right end of said right elbow to extend away therefrom for maintaining the user's shoulders in a neutral position when grasped by a user.

31. The apparatus of claim 30 further comprising weights removably secured to the apparatus.

32. The apparatus of claim 30 further comprising a weight secured proximate the left and right extensions for increasing the moment of inertia of the apparatus.

33. The apparatus of claim 32, wherein the weight is configured to fit inside the apparatus.

34. The apparatus of claim 32, wherein the weight is water.

35. The apparatus of claim 32, wherein the weight is shot.

36. The apparatus of claim 32, wherein the weight is configured for assembly in multiples of an incremental weight.

37. The apparatus of claim 32, wherein the weight is configured to fit outside an outer surface of the tube

38. The apparatus of claim 30, wherein the tube is configured for assembly from and disassembly into sections.

39. The apparatus of claim 38, wherein the tube is disassembled is configured to fit in a case carryable by a user.

40. The apparatus of claim 30, wherein the arcuate portion has a radius of between 3 and 7 inches.

41. The apparatus of claim 30, wherein an angle between the left straight leg and the right straight leg measures between about 100 and 150 degrees.

42. The apparatus of claim 30 configured to fit on a rack adapted to support the tube and a user performing exercises.

* * * * *